US009750359B2

(12) United States Patent
Kah, Jr.

(10) Patent No.: US 9,750,359 B2
(45) Date of Patent: Sep. 5, 2017

(54) DOUBLE WALLED THERMAL CONTAINER WITH RING SEAL

(71) Applicant: Carl L. C. Kah, Jr., North Palm Beach, FL (US)

(72) Inventor: Carl L. C. Kah, Jr., North Palm Beach, FL (US)

( * ) Notice: Subject to any disclaimer, the term of this patent is extended or adjusted under 35 U.S.C. 154(b) by 0 days.

(21) Appl. No.: 13/735,723

(22) Filed: Jan. 7, 2013

(65) Prior Publication Data

US 2013/0175278 A1 Jul. 11, 2013

Related U.S. Application Data

(60) Provisional application No. 61/583,986, filed on Jan. 6, 2012.

(51) Int. Cl.

| | |
|---|---|
| ***F25D 23/00*** | (2006.01) |
| ***A47G 19/22*** | (2006.01) |
| ***B65D 81/38*** | (2006.01) |

(52) U.S. Cl.

CPC ..... *A47G 19/2288* (2013.01); *B65D 81/3869* (2013.01)

(58) Field of Classification Search

CPC . A47G 19/2288; A47J 41/0077; B65D 11/16; B65D 81/3689; B65D 81/38; B65D 81/3812

USPC ..... 206/592.2

See application file for complete search history.

(56) References Cited

U.S. PATENT DOCUMENTS

| | | | | |
|---|---|---|---|---|
| 3,650,427 | A * | 3/1972 | Franklin | 215/12.1 |
| 3,827,925 | A * | 8/1974 | Douglas | 156/73.1 |
| 3,847,494 | A * | 11/1974 | Franklin | 403/345 |
| 4,121,727 | A * | 10/1978 | Robbins et al. | 215/211 |
| 5,573,141 | A * | 11/1996 | Chen | 62/457.3 |
| 6,371,328 | B1 * | 4/2002 | Yamada et al. | 220/592.2 |
| 7,104,413 | B2 * | 9/2006 | Liu | 215/12.1 |
| 7,216,504 | B2 * | 5/2007 | Armer et al. | 62/457.2 |

* cited by examiner

*Primary Examiner* — Anthony Stashick
*Assistant Examiner* — James M Van Buskirk
(74) *Attorney, Agent, or Firm* — Ostrolenk Faber LLP

(57) ABSTRACT

A double walled thermal container includes an outer container with an inner container mounted therein. Structural support is provided by an internal connection between the inner container and the outer container to minimize stress on the connection point. A separate elastomeric seal is preferably provided to prevent moisture from entering the area between the inner and outer containers.

7 Claims, 14 Drawing Sheets

DOUBLE WALLED THERMAL CONTAINER WITH RING SEAL

CROSS REFERENCE TO RELATED APPLICATIONS

The present Application claims benefit of and priority to U.S. Provisional Patent Application No. 61/583,986 filed Jan. 6, 2012 entitled DOUBLE WALLED THERMAL CONTAINER WITH RING SEAL, the entire content of which is hereby incorporated by reference herein.

BACKGROUND

Fields of the Disclosure

The present disclosure relates to a double walled thermal glass, cup, or other container with improved reliability.

Related Art

Double walled glasses and cups are produced in large quantities to provide thermal insulation for hot and cold drinks. These vessels are commonly molded using clear, high luster plastic materials such as polycarbonate, for example, and then sonic welded together to form a seal between the inner liquid containing chamber and the outer covering chamber. The area between the inner container and the outer housing provides thermal insulation between the inside and outside of the container. Stress cracking in the interface of the welded seal, however, leads to reliability problems. After continued usage or washing, especially in dishwashers with a hot dry cycle, stress fractures are common. Even a small crack may allow thermal cycle pumping of moisture into the area between the inner and outer containers. This reduces the insulation provided by this area. Further, the moisture condenses to provide a cloudy appearance which may interfere with viewing or damage artwork or other indicia typically provided in this area for decoration. The use of more costly and attractive inner container artwork is thus prohibited due to future failure replacement costs.

Accordingly it would be beneficial to provide a double walled thermal container that avoids these and other problems.

SUMMARY

It is an object of the present disclosure to provide a double walled thermal container that resolves the long-term reliability problems associated with conventional double walled thermal cups and containers.

It is also an object of this disclosure to provide a simple, low cost and easy to implement configuration for a double walled thermal container that resolves the reliability problems of conventional double walled thermal cups and glasses.

A container in accordance with an embodiment of the present disclosure includes an outer container including a first bottom element and a first sidewall extending upward from the first bottom element, an inner container including a second bottom element and a second sidewall extending upward from the second bottom element, the inner container mounted in the outer container and a connecting element configured to connect the first bottom element to the second bottom element inner container.

Other features and advantages of the present disclosure will become apparent from the following description, which refers to the accompanying drawings.

DETAILED DESCRIPTION OF THE EMBODIMENTS

Figure 1:
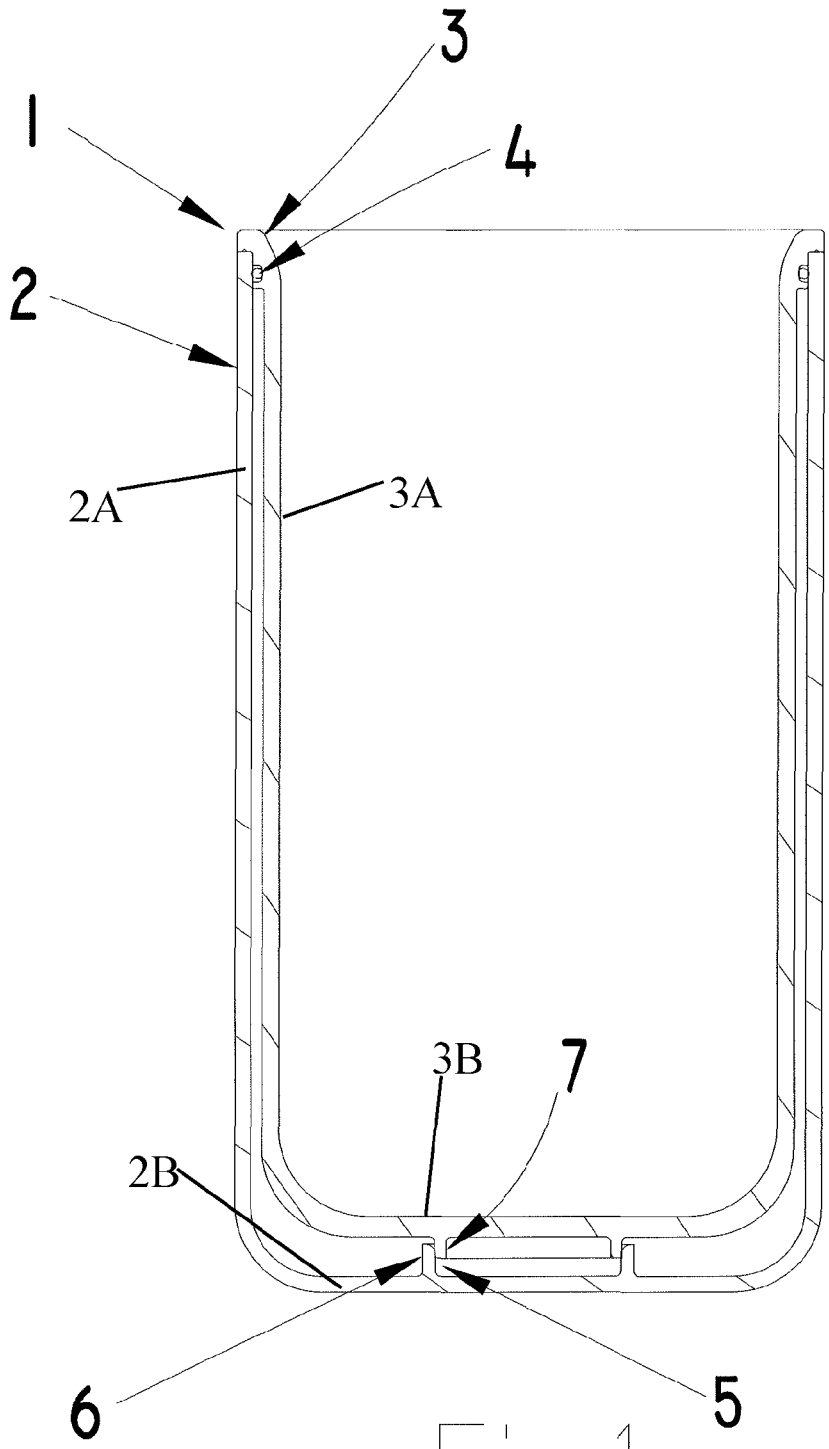
FIG. 1 illustrates a cross sectional view of a double walled thermal container in accordance with an embodiment of the present application, where the structural connection between the inner and outer containers is internal and a seal is an elastic O-ring.
Figure 2:
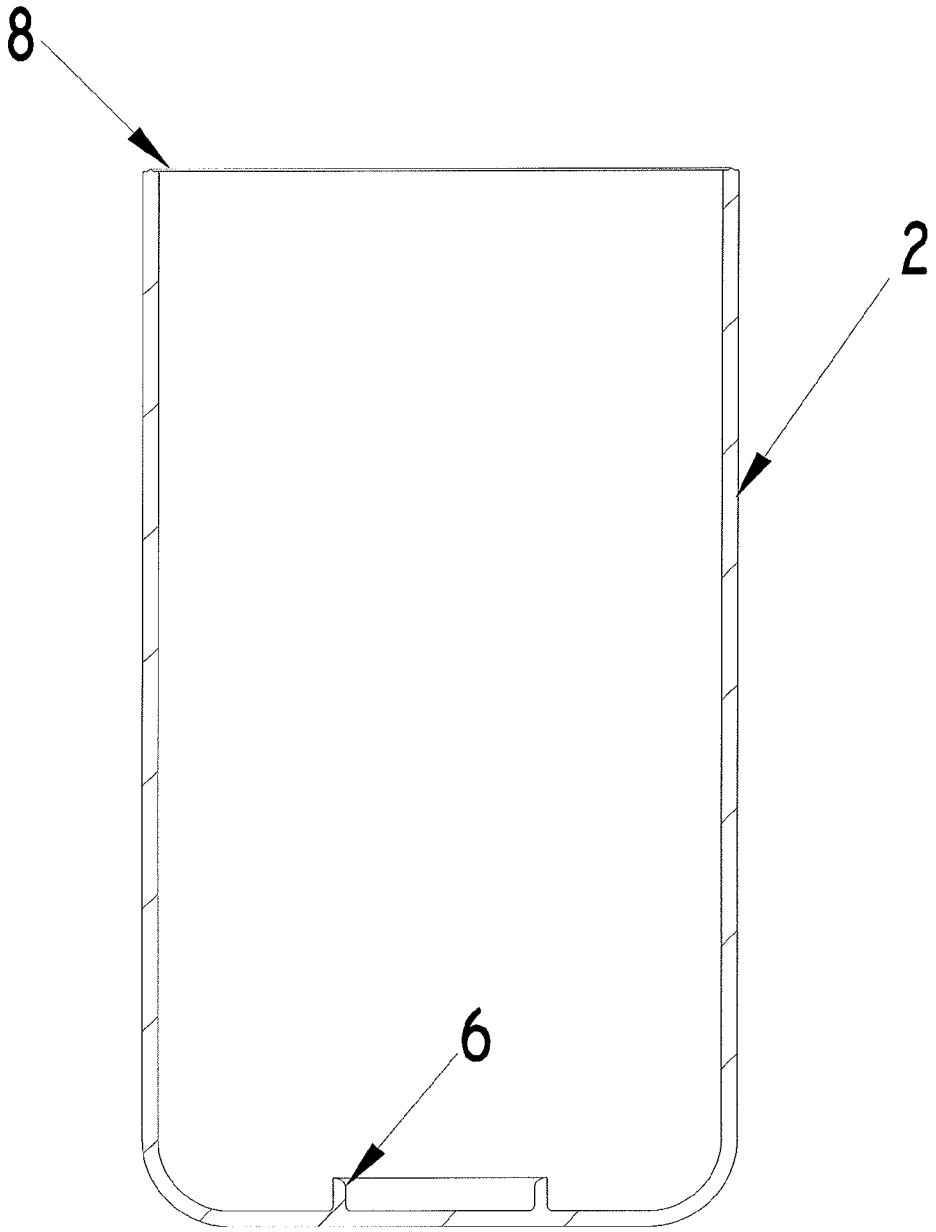
FIG. 2 illustrates a cross sectional view of the outer container of the double walled thermal container of FIG. 1.
Figure 3:
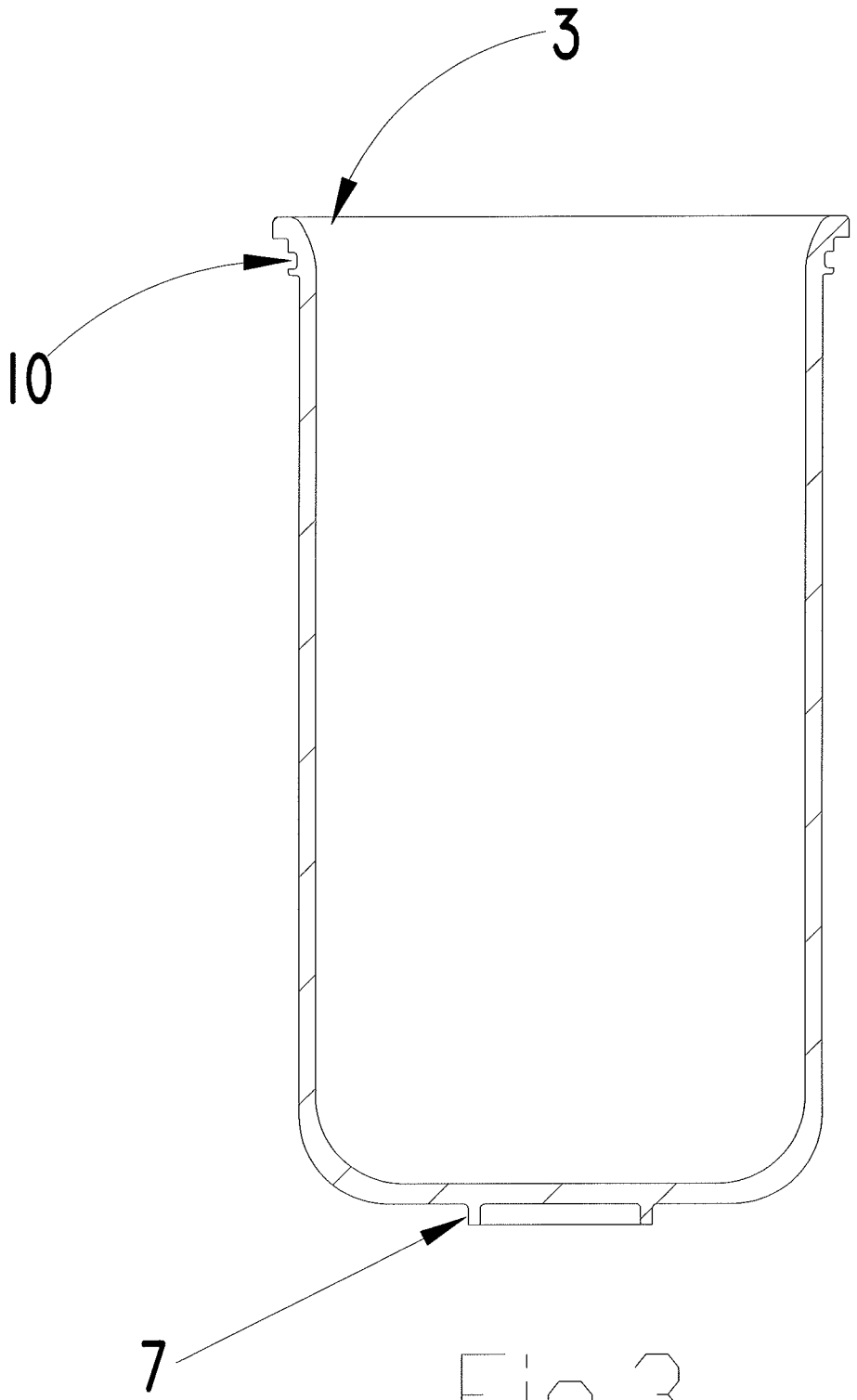
FIG. 3 illustrates a cross sectional view of the inner container of the double walled thermal container of FIG. 1.

A double walled thermal container 1 in accordance with an embodiment of the present disclosure is illustrated in FIG. 1. The container 1 preferably includes an outer container 2 in which an inner container 3 is mounted. FIG. 2 illustrates the outer container 2 alone while FIG. 3 illustrates the inner container 3 alone.

Figure 6:
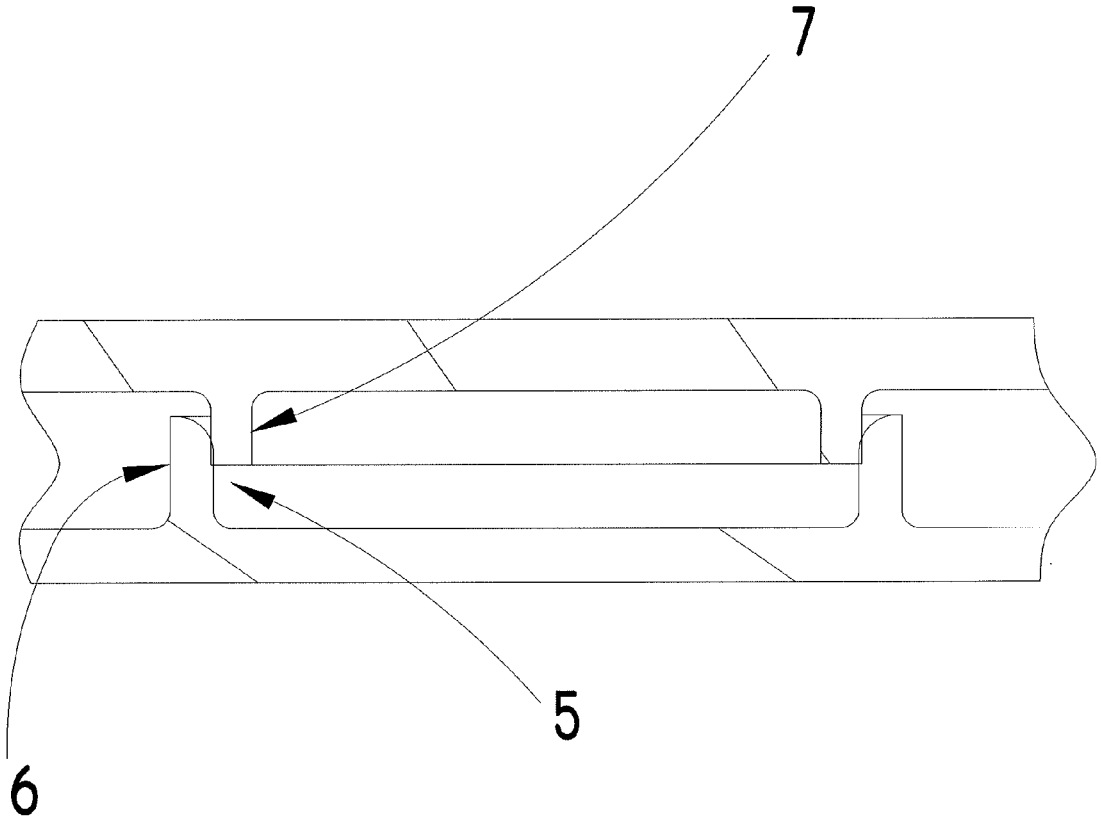
FIG. 6 illustrates an expanded cross sectional view of a bottom portion of the inner container and outer container of the double walled thermal container of FIG. 1 illustrating attachment via a sonic shear weld, or a location for a snap fit retaining connection between the inner and outer container.
Figure 10:
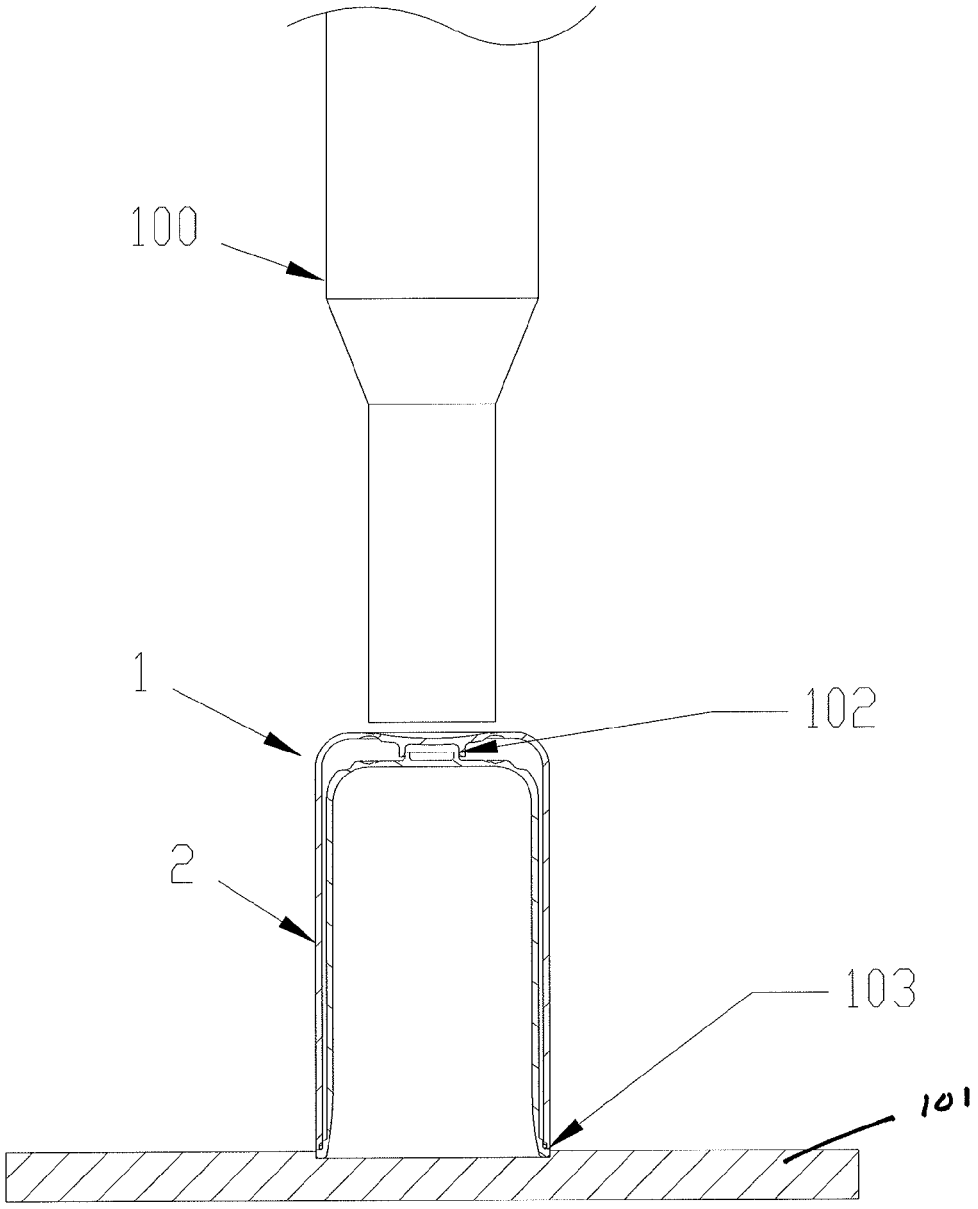
FIG. 10 shows an exemplary sonic welding nest and horn for internally sonic welding the inner and outer container.

In an embodiment, the structural support and retention between the inner and outer containers 3, 2 is provided at a center of the bottom of each of the inner and outer containers. Specifically, the outer container 2 preferably includes a sidewall 2A and an upward extending, ring shaped protrusion 6 positioned substantially in a center of the bottom surface of the bottom element 2B of the outer container 2. A downward extending, ring shaped protrusion 7 is provided on a bottom surface of the bottom element 3B of the inner container 3. The inner container 3 also includes a sidewall 3A. As can be seen in FIG. 6, the minimum inner diameter of ring 6 is slightly less than the maximum outer diameter of the ring 7. The bottom of the outer container 2 is easily contacted by a sonic welding horn element (see element 100 of FIG. 10, for example) and the inside bottom portion of the inner container is accessibly to a fixing mandrel (See element 101 of FIG. 10, for example) of a sonic welder such that the protrusions 6 and 7 are easily joined by sonic welding. The sonic weld is highlighted by arrow 5, for example, in FIG. 1. The material stresses induced by such structural sonic welding are removed from the outside of the container 1. Further, this weld does not provide a sealing function, such that there can be no moisture leaks even if cracks form at this weld. In FIG. 10, the sonic welds are highlighted at points 102, 103.

Figure 9:
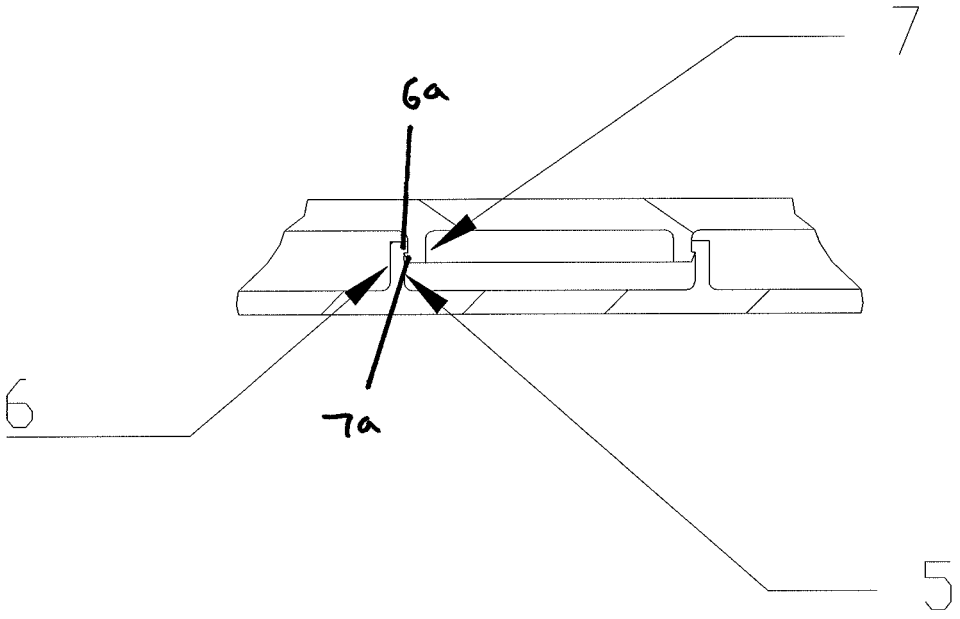
FIG. 9 shows an expanded cross sectional view of a bottom portion of the inner and outer container of the double walled thermal container of FIG. 6 illustrating attachment via a snap fit connection between a protrusion from the bottom of the inner container and a matching socket protrusion on the outer container bottom.

Applicant notes that no sonic weld is necessary where the inner and outer containers 2, 3 are connected via a press fit or snap fit connection, as illustrated in FIG. 9, for example. In FIG. 9, the protrusion 7 of the inner container 3 includes outward extending lip 7*a* that snaps over the annular flange 6*a* formed on an inner surface of the protrusion 6.

Figure 4:
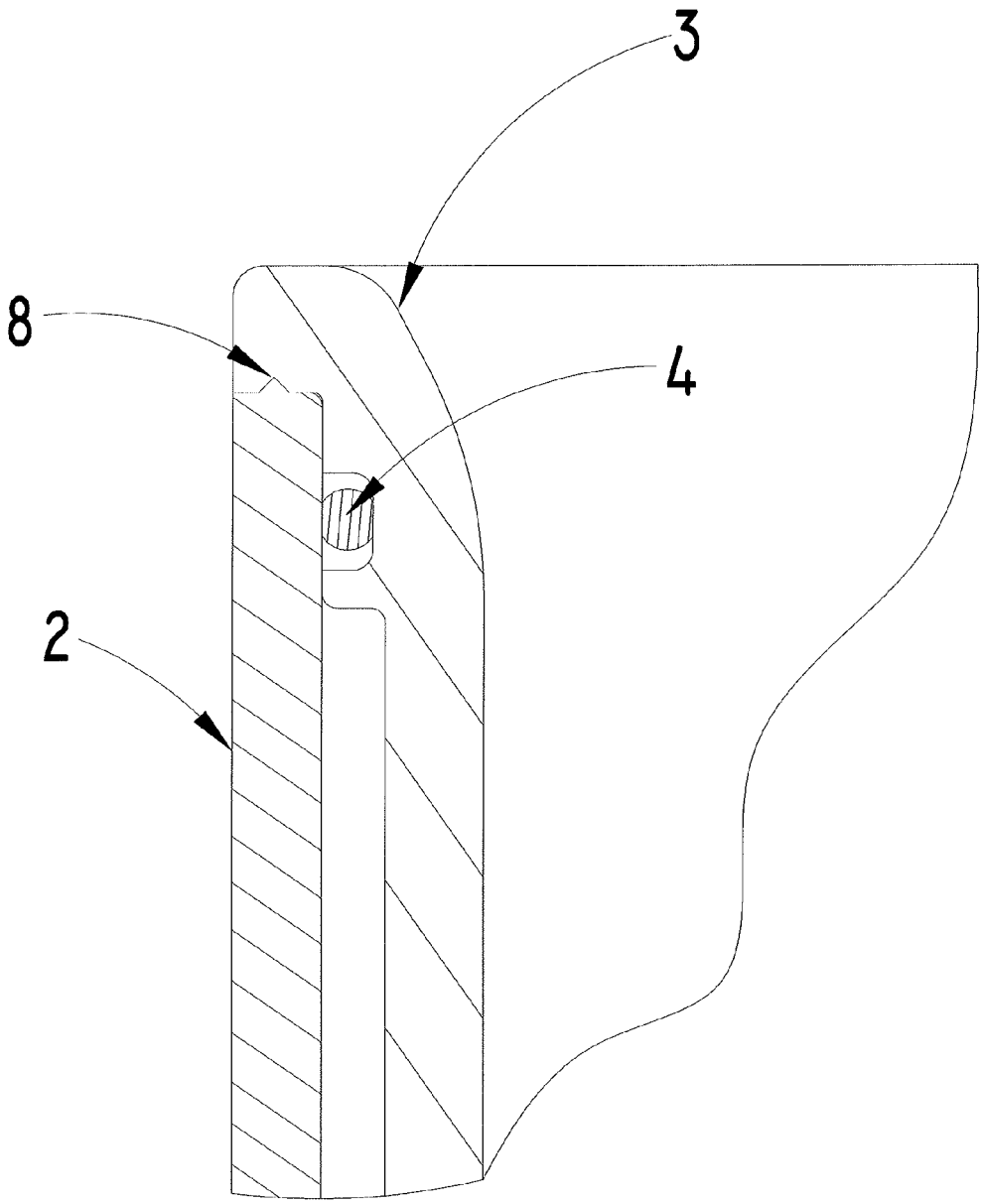
FIG. 4 illustrates an expanded cross sectional view of the inner and outer containers of the double walled thermal container of FIG. 1 at the seal area.

The interface between the inner and outer containers 3, 2 is preferably sealed using an O-ring 4, as illustrated in detail in FIG. 4, for example. While an O-ring is illustrated, any suitable elastomeric material may be used and may be provided in any desired shape. The O-ring may be provided on the inner container 3 prior to insertion and welding of the inner container to the outer container 2, or may be co-molded onto the inner container during the molding operation and then inserted into the outer container.

Figure 5:
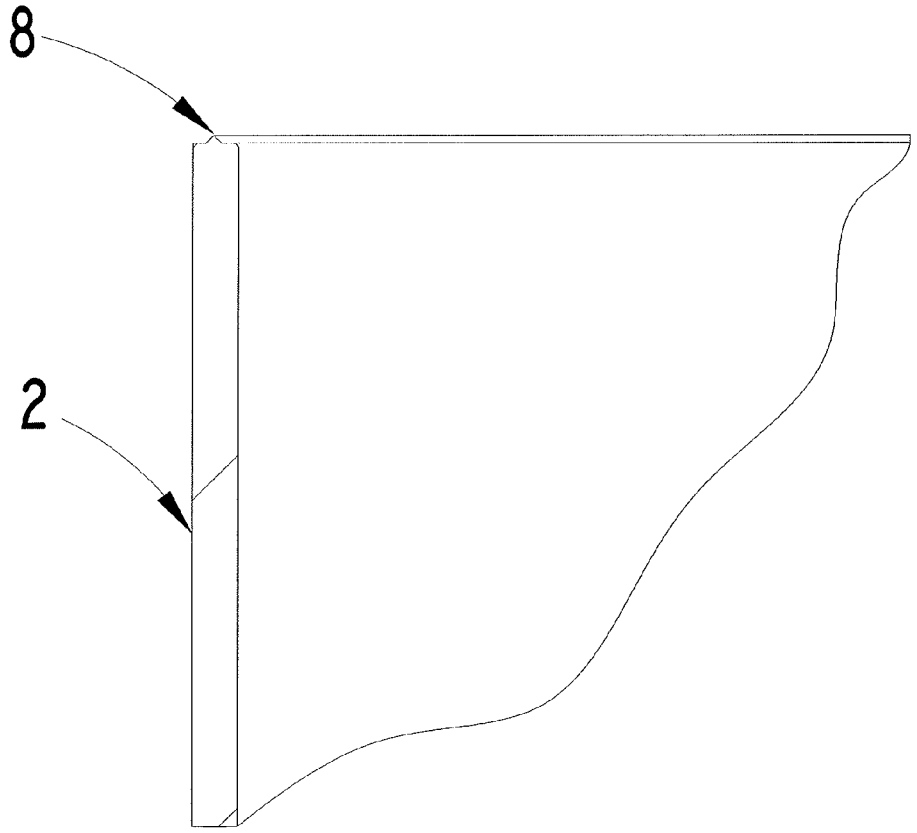
FIG. 5 is an more detailed view of the upper edge of the outer container of the double walled thermal container of FIG. 1 illustrating a small energy directing sonic weld seal edge.

In an embodiment, the upper, outer edges between the inner and outer containers 3, 2 may include a small energy directing ridge seal 8 (See FIGS. 3-5) which is backed up by the seal 4 to ensure long life and a moisture free and clear inner area between the containers 3, 2. That is, when vibration is applied to the bottom of the container 1 via the sonic welder, as discussed above, a sealing weld will form long the ridge 8, as well. However, this relatively weak seal is backed-up by the elastomeric seal 4 to ensure that moisture does not enter the area between the inner and outer containers 3, 2 to cloud the view of any inner container art work or patches. This may be done as a very low energy sonic weld operation.

Figure 7:
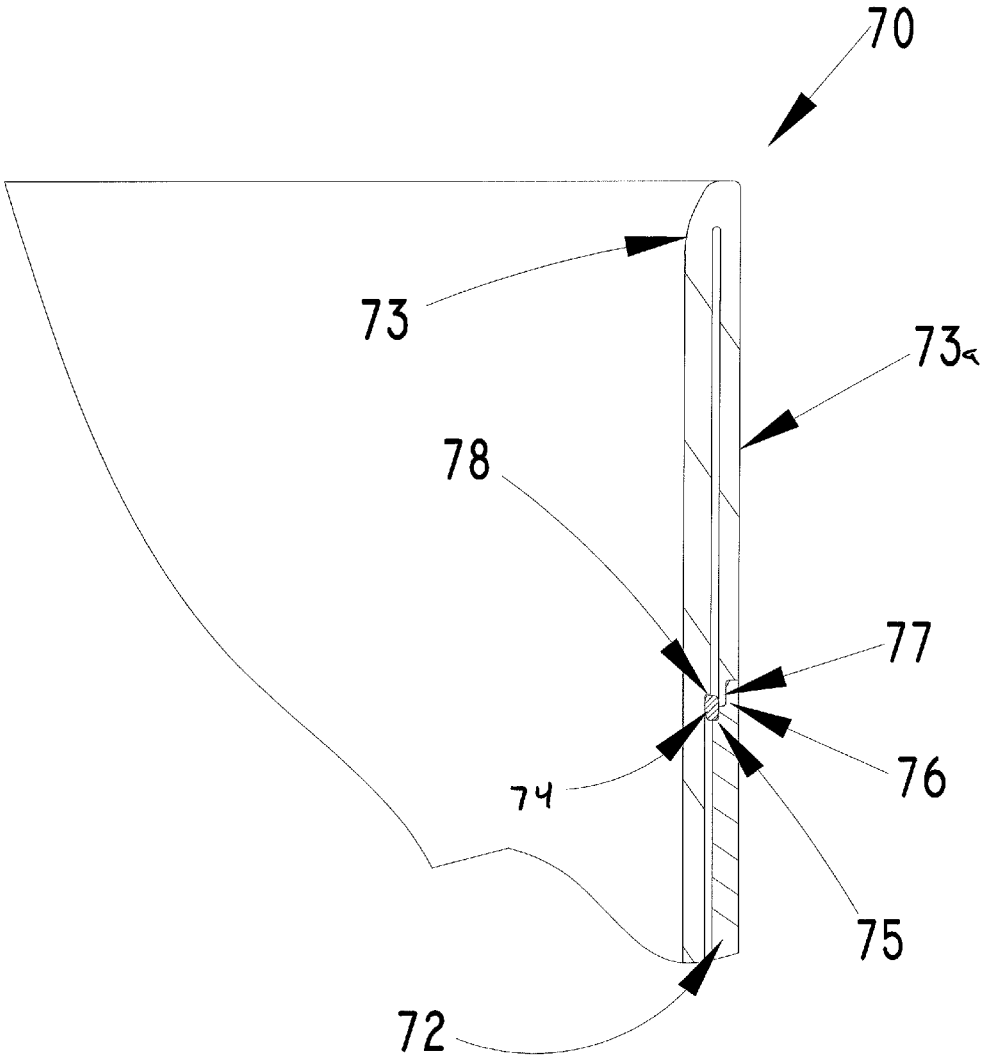
FIG. 7 illustrates a more detailed cross sectional view of a portion of a double walled thermal container in accordance with an embodiment of the present disclosure illustrating a structural connection positioned internally and with the seal relocated to the side circumference with a circumferential elastomeric banded sealing ring.
Figure 8:
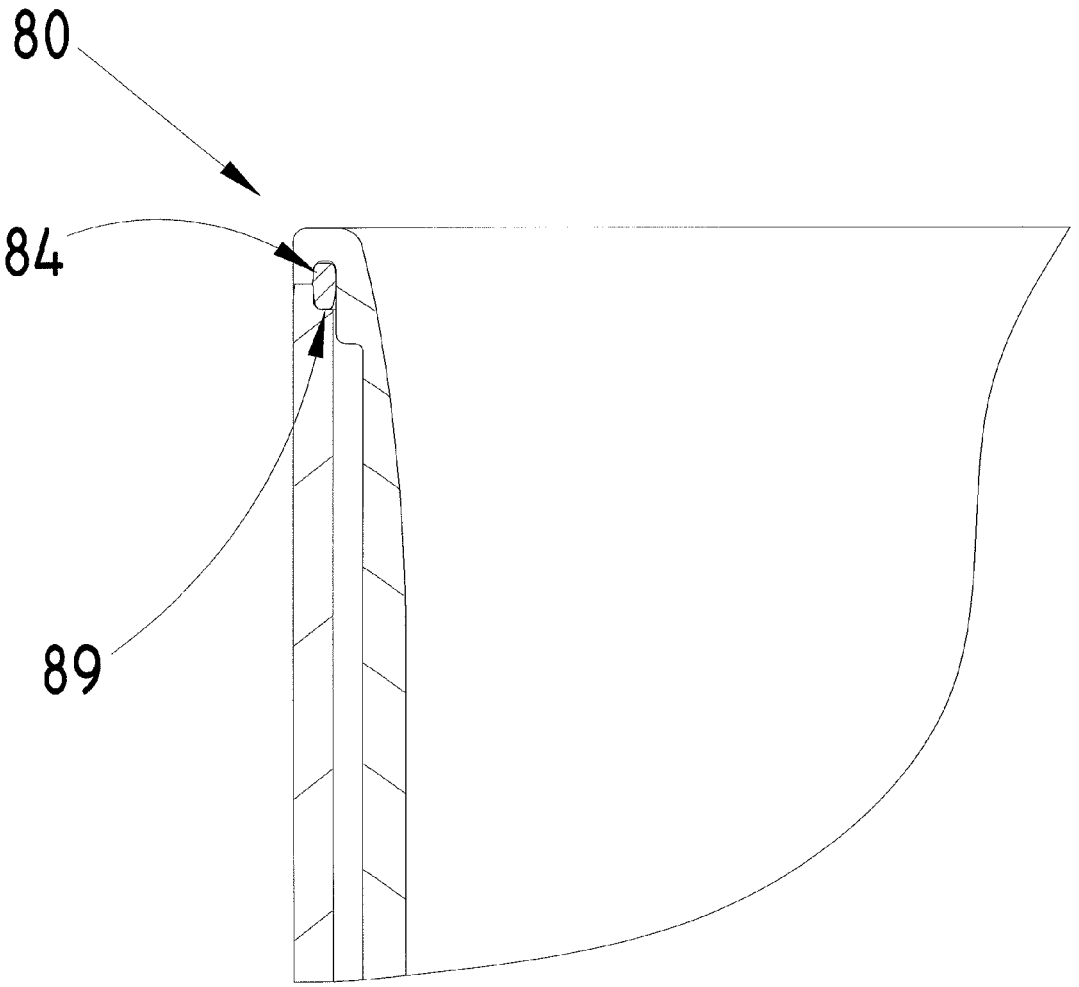
FIG. 8 illustrates an alternate seal configuration with the seal positioned between the inner and outer containers and straddling the junction between the inner and outer containers walls.

The seal area may be positioned lower on the side of the container 1, if desired, with the elastomeric seal 4 bridging the interface between the inner and outer containers 3, 2, if desired, as shown in FIG. 7, for example. In FIG. 7, the inner and outer containers 73, 72 meet at a junction with an elastomeric seal 74 bridging the junction. In this embodiment, the inner container 73 includes an external portion 73*a* that extends downward on the outside of container 70. An overlapping ridge 77 of the inner container 73 overlaps ridge 76 of outer container 73. The element 75 refers to the sonic weld at the junction. FIG. 8 similarly illustrates an elastomeric seal 84 straddling the inner and outer containers, but at a top of double walled thermal container 80. Otherwise, the container 80 is similar to the container 1 described above.

Figure 11A:
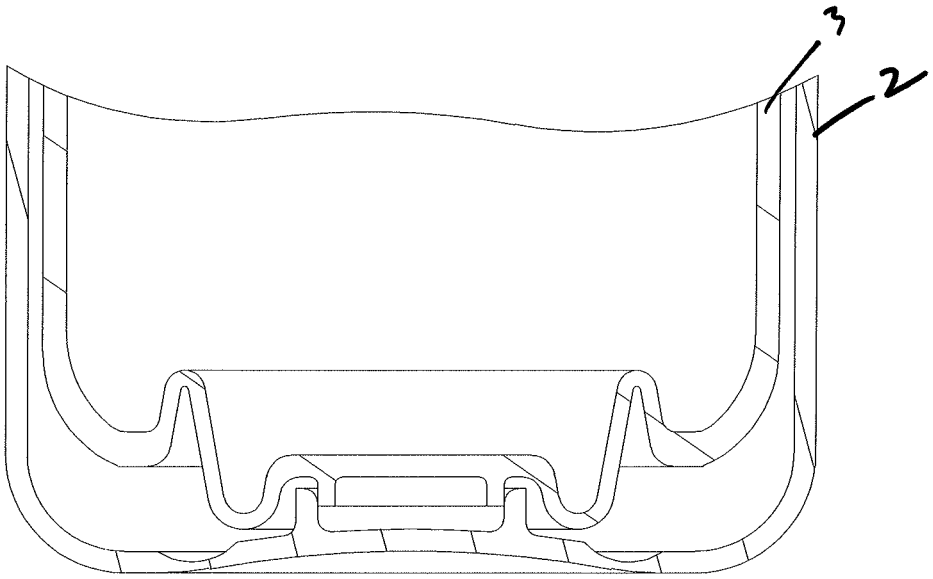
FIGS. 11A-11C illustrate exemplary configurations for adding additional wall flexibility to allow for thermal differential expansion between the inner and outer container.
Figure 11B:
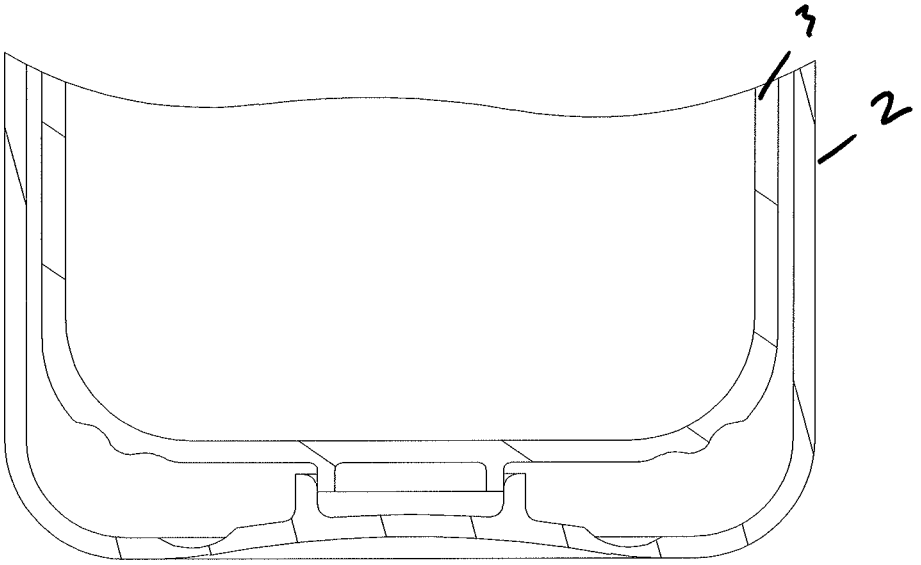
Figure 11C:
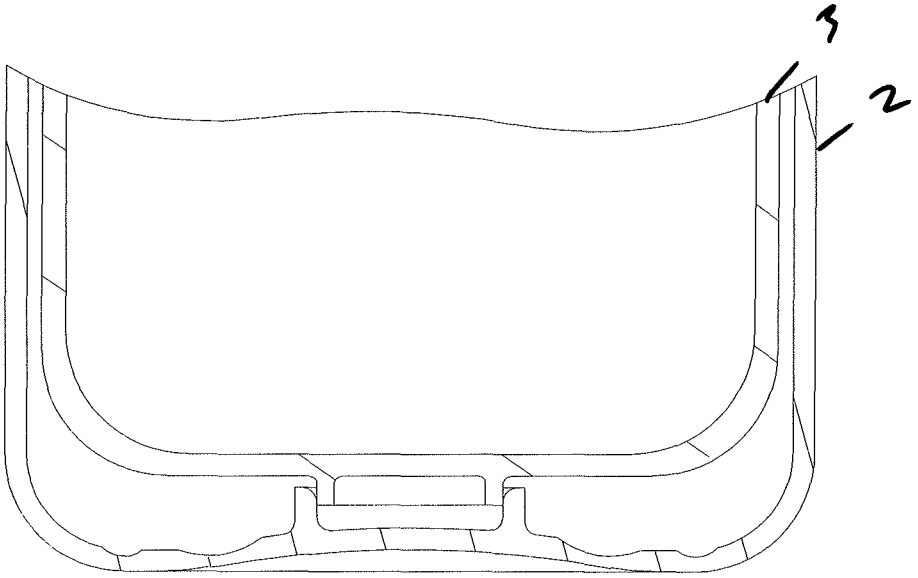

In an embodiment, in which the double walled thermal container 1 is tall and deep, relatively small diameter flexible wall surfaces may be provided in the inner and outer containers 3, 2 as shown in FIGS. 11A-11C, for example. FIGS. 11A-11C illustrate exemplary configurations in which additional wall flexibility is provided to allow for differential thermal expansion between the inner and outer container 3, 2 once the mechanical connection is made. The folds in the bottom elements of the inner and outer containers 3, 2 allow for increased flexibility.

Figure 12:
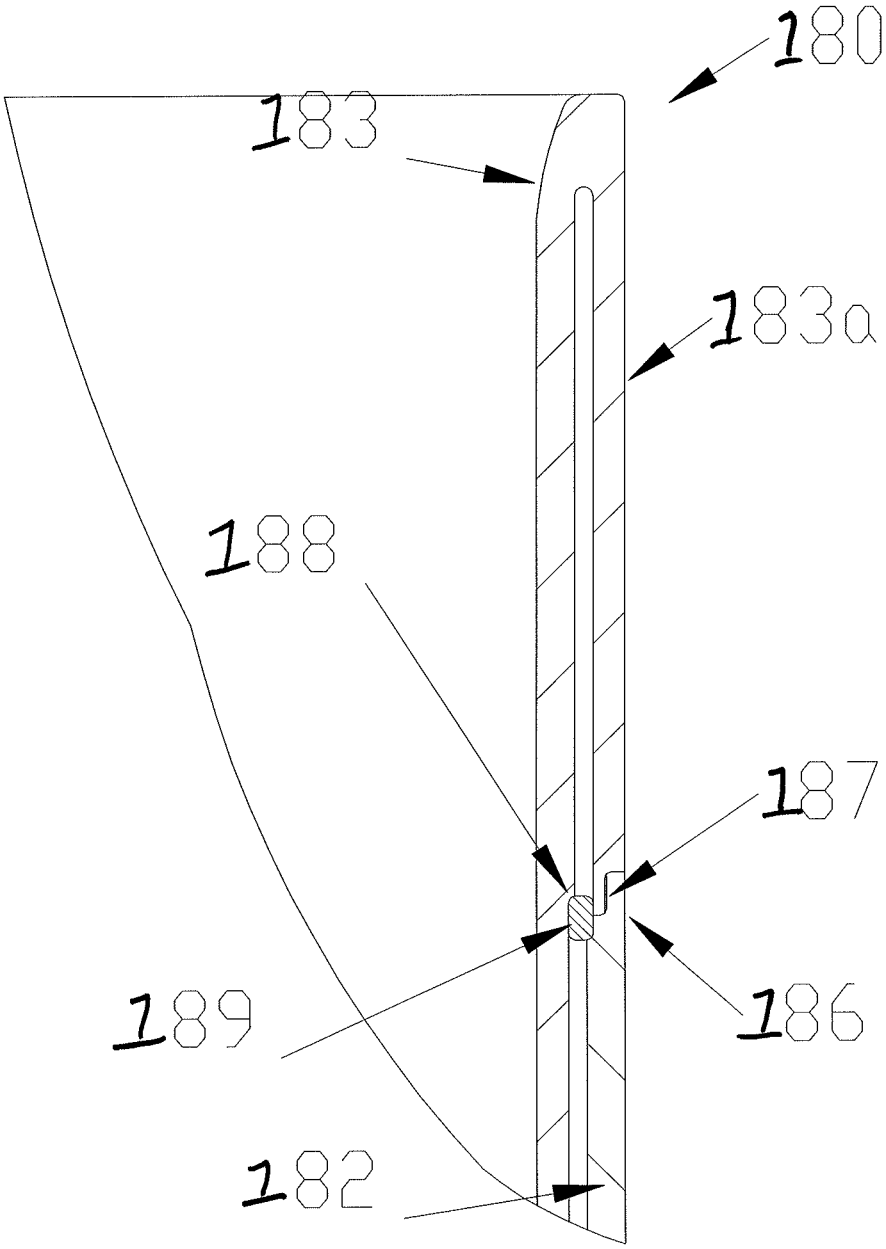
FIG. 12 illustrates a detailed cross sectional view of a portion of a double walled thermal container in accordance with another embodiment of the present disclosure illustrating a structural connection positioned on a lower side wall intersection between the inner and outer container where the inner container upper edge extends downwardly from its top edge as shown in FIG. 7 and includes a circumferential connection between the inner and outer container which is sheer welded together and the outside circumferential mechanical connection weld is backed up by as elastomeric seal ring inside positioned between the inner and outer containers after the mechanical attachment sonic weld is made.

FIG. 12 illustrates a detailed cross sectional view of a double walled thermal container similar to that of FIG. 7 with the attachment weld between the inner and outer container 183, 182 moved back to the outside for attachment so that the inner and outer container 183, 182 remain free to expand differentially for small diameter tall containers, but the structural weld which is now around the outside circumference is bridged by an internal elastomeric seal material 89 which can also be sonic welded as the outer and inner walls are mechanically connected. The elastomeric seal 189 backs up and bridges the junction between the inner container 183 and the outer container 182. Element 187 highlights the sonic weld. Element 188 refers to a groove provided to accommodate the seal 189. The inner container 183 includes an outer wall 183*a* extending to the outside of the container 180 and down to the junction between the inner and outer containers.

Although the present invention has been described in relation to particular embodiments thereof, many other variations and modifications and other uses will become apparent to those skilled in the art.

What is claimed is:

1. A container comprising:

an outer container including a first bottom element and a first sidewall extending upward from the first bottom element;

an inner container including a second bottom element and a second sidewall extending upward from the second bottom element, the inner container mounted in the outer container;

the first sidewall sonic welded to the second sidewall at a top portion of the container to join the first sidewall and the second sidewall;

a seal element molded into the second sidewall and sonic-welded to the first sidewall at a position just below the sonic weld of the first sidewall and the second sidewall at the top portion of the container; and a lower connecting element provided between a top surface of the first bottom element and a bottom surface of the second bottom element to provide a second sonic-welded connection between the inner container and outer container.

2. The container of claim 1, wherein the lower connecting element further comprises:

a connecting ring formed on the first bottom element and extending upward therefrom; and a support element extending downward from the second bottom element and contacting the connecting ring.

3. The contained of claim 2, wherein the connecting ring is sonic welded to the support element.

4. The container of claim 1, wherein the seal element is made of an elastomeric material.

5. The container of claim 1, wherein the seal element is an elastomeric O-ring.

6. A container comprising:

an outer container including a first bottom element and a first sidewall extending upward from the first bottom element;

an inner container including a second bottom element and a second sidewall extending upward from the second bottom element, the inner container mounted in the outer container;

the first sidewall and second sidewall sonic welded together at a top portion of the container;

a lower connecting element, provided between a top surface of the first bottom element and a bottom surface of the second bottom element to provide a second airtight connection between the inner container and outer container; and a seal element molded into the first sidewall and sonic welded to the second sidewall directly below the sonic weld between the first sidewall and the second sidewall at the top portion of the container and above the lower connecting element to provide a hermetic seal between the outer container and the inner container.

7. A container comprising:

an outer container including a first bottom element and a first sidewall extending upward from the first bottom element;

an inner container including a second bottom element and a second sidewall extending upward from the second bottom element, the inner container mounted in the outer container;

the first sidewall sonic connected to the second sidewall at a top portion of the container to join the first sidewall and the second sidewall;

a seal element molded into the second sidewall and sonic-welded to the first sidewall at a position just below the connection of the first sidewall and the second sidewall at the top portion of the container; and a lower connecting element provided between a top surface of the first bottom element and a bottom surface of the second bottom element to provide a sonic-welded connection between the inner container and outer container.

* * * * *